US010273744B2

(12) United States Patent
Lebron et al.

(10) Patent No.: US 10,273,744 B2
(45) Date of Patent: Apr. 30, 2019

(54) UNIVERSAL STRUT FOR DOORS AND WINDOW ELEMENTS, APPARATUS, SYSTEM, AND A METHOD THEREOF

(71) Applicant: Fenestration Technologies, LLC., Rio Blanco, PR (US)

(72) Inventors: Maria E. Perez Lebron, Rio Blanco, PR (US); Candido Perez, Rio Blanco, PR (US)

(73) Assignee: FENESTRATION TECHNOLOGIES, LLC., Rio Blanco, PR (US)

( * ) Notice: Subject to any disclaimer, the term of this patent is extended or adjusted under 35 U.S.C. 154(b) by 0 days.

(21) Appl. No.: 15/431,067

(22) Filed: Feb. 13, 2017

(65) Prior Publication Data

US 2017/0234058 A1 Aug. 17, 2017

Related U.S. Application Data

(60) Provisional application No. 62/294,653, filed on Feb. 12, 2016.

(51) Int. Cl.

| | |
|---|---|
| ***E06B 3/54*** | (2006.01) |
| ***E06B 1/32*** | (2006.01) |
| ***E06B 3/08*** | (2006.01) |
| ***E06B 3/30*** | (2006.01) |
| ***E06B 3/58*** | (2006.01) |

(52) U.S. Cl.

CPC ..... *E06B 3/549* (2013.01); *E06B 1/325* (2013.01); *E06B 3/08* (2013.01); *E06B 3/306* (2013.01); *E06B 3/5878* (2013.01)

(58) Field of Classification Search

CPC ..... E06B 3/5878; E06B 3/306; E06B 1/325; E06B 3/08; E06B 3/549; E06B 3/50; E06B 1/36; E06B 2001/628; E06B 1/56; E05Y 2900/148; E05D 15/30; E05D 15/44

USPC .... 52/204.1, 20.5, 656, 656.4, 656.5, 204.5; 49/246, 247, 248, 249, 394, 395

See application file for complete search history.

(56) References Cited

U.S. PATENT DOCUMENTS 4,856,239 A * 8/1989 Elsasser ..... E06B 1/30 52/98

5,560,155 A * 10/1996 Back ..... E04B 1/0046 52/204.7

(Continued)

*Primary Examiner* — Brian E Glessner
*Assistant Examiner* — Adam G Barlow
(74) *Attorney, Agent, or Firm* — Aziz M. Ahsan; Ahsan & Associates, PLLC

(57) ABSTRACT

The present invention relates generally to a universal strut for doors and window elements. More particularly, the invention encompasses a universal strut that mates with a first formed member, and a second formed member, and which assembly is used as windows, doors, window frames, and door frames. The invention also provides a method of using the inventive universal strut for applications that require different widths and lengths for a production or customized window, door, window frame, or door frame. The universal strut can also be used as a thermal barrier between the first formed member, and the second formed member. Preferably, the universal strut is made from a non-metallic or thermal barrier material, while the first formed substrate, and the second formed substrate are preferably made from a metallic material. The universal strut allows for the formation of various configurations for the shapes of window and/or door elements.

20 Claims, 7 Drawing Sheets

(56) References Cited

U.S. PATENT DOCUMENTS

| | | | | |
|---|---|---|---|---|
| 5,771,640 | A * | 6/1998 | Back | E04B 1/0046 52/204.7 |
| 8,286,396 | B2 * | 10/2012 | Brunnhofer | E06B 3/26303 49/501 |
| 8,484,902 | B1 | 7/2013 | Brown et al. | |
| 8,561,365 | B2 * | 10/2013 | Albrecht | E05B 63/0052 52/204.5 |
| 8,572,929 | B2 | 11/2013 | Stumm | |
| 9,127,498 | B1 * | 9/2015 | Ye | E06B 3/24 |
| 9,328,549 | B1 * | 5/2016 | Alexander | E06B 1/325 |
| 2008/0196342 | A1 * | 8/2008 | Franklin | E06B 3/26341 52/309.1 |
| 2011/0011028 | A1 * | 1/2011 | Rawlings | E06B 3/26303 52/656.5 |
| 2014/0053479 | A1 * | 2/2014 | Valler | E06B 3/964 52/204.5 |
| 2017/0167185 | A1 * | 6/2017 | Boer | E06B 1/18 |

* cited by examiner

UNIVERSAL STRUT FOR DOORS AND WINDOW ELEMENTS, APPARATUS, SYSTEM, AND A METHOD THEREOF

CROSS-REFERENCE TO RELATED APPLICATION

The instant patent application claims priority to and the benefit of U.S. Provisional Patent Application Ser. No. 62/294,653, filed on Feb. 12, 2016, titled "Universal Strut For Doors and Window Elements, Apparatus, System, And A Method Thereof," the entire disclosure of which provisional application is incorporated herein by reference.

FIELD OF THE INVENTION

The present invention relates generally to a universal strut for doors and window elements. More particularly, the invention encompasses a universal strut that mates with a first formed member, and a second formed member, and which assembly is used as windows, doors, window frames, and door frames. The invention also provides a method of using the inventive universal strut for applications that require different widths and lengths for a production or customized window, door, window frame, or door frame. The universal strut can also be used as a thermal barrier between the first formed member, and the second formed member. Preferably, the universal strut is made from a non-metallic or thermal barrier material, while the first formed substrate, and the second formed substrate are preferably made from a metallic material. The universal strut allows for the formation of various configurations for the shapes of window and/or door elements.

BACKGROUND INFORMATION

The fenestration industry has used several methods of creating thermal barriers for windows and doors. The problem with the existing methods is that they have numerous limitations.

One way to address the thermal barrier issues for doors and windows has been to use poured and de-bridged method which has been done by pouring of a liquid urethane into a hollow cavity of an aluminum extrusion. Once hardened the aluminum on the back side of the hollow is then de-burred leaving only the urethane to hold the substrate together. With this method numerous issues have been encountered, such as, for example, (a) over the years the urethane would become brittle and crack, and therefore then allowed for air and water infiltration through the substrate, (b) this method is limited to aluminum extrusions only, (c) this method allows for a single color only for the substrate, to name a few.

Polyamide stitched into a Euro-bar was another improvement as a type of a thermal barrier. However, this solution created the possibility to combine two different extrusions with two different finishes. However, the polyamide stitched into a Euro-bar process is limited to aluminum extrusions only.

Another method proposed by U.S. Pat. No. 8,572,929 (Wolfgang Stumm), the entire disclosure of which is incorporated herein by reference, disclosed that in the case of a window or door element (1) having a metal frame and an insulated glass pane (7) inserted into the frame (2), a solution is to be created, with which such window or door elements can be produced without requiring, cold-forming, extrusion production of light-metal profiles, or another form of production of the frame elements. This is achieved in that the outer and/or inner surface of the frame (2) is formed, in each instance, by a flat metal frame (4, 5), wherein an insulation body (3) is positioned between the frame elements (4, 5), using sandwich construction.

U.S. Pat. No. 8,484,902 (John E. Brown, et al.), the entire disclosure of which is incorporated herein by reference, discloses a window assembly which includes a window frame having a front wall and a lateral wall, the window frame being set within a building opening. A thermal break liner having a laterally extending portion is provided wherein the laterally extending portion is positioned on the lateral wall of the window frame. The window assembly also includes a glazing with at least one pane of glass mounted in the window frame, a glazing bead for holding the glazing in place against the window frame, and a glazing bead retainer fixed to the thermal break liner for retaining the glazing bead in place on the thermal break liner. The thermal break liner is formed of a material having a low thermal transmittance factor and is positioned to prevent direct contact and thermal transfer between the glazing bead and the window frame. The window assembly may be a fixed or operable window assembly.

This invention improves on the deficiencies of the prior art and provides an inventive universal strut for doors and window elements, apparatus, system, and a method thereof.

PURPOSES AND SUMMARY OF THE INVENTION

The invention is a novel universal strut for doors and window elements, apparatus, system, and a method thereof.

Therefore, one purpose of this invention is to provide a universal strut that can be mated with a first formed member at one end, and a second formed member at the opposite end, and then use this assembly for doors and window elements.

Another purpose of this invention is to provide a universal strut that can have varying lengths and widths for use with doors and window elements.

Yet another purpose of this invention is to provide a universal strut that can be mated with a first formed member at one end, and a second formed member at the opposite end, and then use this assembly for doors and window elements, and where the universal strut is preferably made from a thermal barrier material, while the first formed member, and the second formed member are made preferably from a metallic material.

Therefore, in one aspect this invention comprises a universal strut for door or window element, comprising:

(a) a member having a first leg, a second leg, and a third leg, and wherein said first leg has a first length, said second leg has a second length, and said third leg has a third length, and wherein said second length and said third length are less than said first length;

(b) a first bridge member, said first bridge member connects said first leg to said second leg, to form a first blind hole on a first side, and a second blind hole on a second side, and wherein said first blind hole is opposite said second blind hole;

(c) a second bridge member, said second bridge member connects said first leg to said third leg, to form a third blind hole on a first side, and a fourth blind hole on a second side, and wherein said third blind hole is opposite said fourth blind hole; and (d) wherein said second blind hole and said third blind hole are opposite each other, and wherein said second leg is separated from said third leg via a gap, and thereby forming said universal strut for doors or window element.

In another aspect this invention comprises a window or door element, comprising:

(a) a universal strut, said universal strut comprising a first leg, a first partial leg, and a second partial leg, and wherein said first partial leg is connected to said first leg via at least one first connecting member to form a first external blind hole, and a first internal blind hole, and said second partial leg is connected to said first leg via at least one second connecting member to form a second external blind hole, and a first internal blind hole, and wherein said first partial leg, and said second partial leg are along a first side of said first leg;

(b) a first formed member having a male portion, and wherein at least a portion of said male portion is secured inside at least a portion of said first external blind hole;

(c) a second formed member having a male portion, and wherein at least a portion of said male portion is secured inside at least a portion of said second external blind hole;

(d) said universal strut, said first formed member, and said second formed member form a frame for said window or door element; and (e) at least one glass pane secured inside said frame to form said window or door element.

In yet another aspect this invention comprises a window or door element, comprising:

(a) a universal strut, said universal strut comprising a first leg, a first partial leg, and a second partial leg, and wherein said first partial leg is connected to said first leg via at least one first connecting member to form a first external blind hole, and a first internal blind hole, and said second partial leg is connected to said first leg via at least one second connecting member to form a second external blind hole, and a first internal blind hole, and wherein said first partial leg, and said second partial leg are along a first side of said first leg;

(b) a first formed member having a male portion, and wherein at least a portion of said male portion is secured inside at least a portion of said first external blind hole;

(c) a second formed member having a male portion, and wherein at least a portion of said male portion is secured inside at least a portion of said second external blind hole;

(d) said universal strut, said first formed member, and said second formed member form a frame for said window or door element;

(e) at least one glass pane secured inside said frame;

(f) wherein material for said universal strut is selected from a group consisting of aluminum, bronze, vinyl, pultrusion, plastic, polyamide, wood, steel, stainless steel, fiberglass, ceramic, composite material, and combination thereof; and (g) wherein material for said first formed member and said second formed member is selected from a group consisting of aluminum, bronze, vinyl, pultrusion, plastic, polyamide, wood, steel, stainless steel, composite material, and combinations thereof.

BRIEF DESCRIPTION OF THE DRAWINGS

The invention may best be further understood by reference to the ensuing detailed description in conjunction with the drawings in which.

DETAILED DESCRIPTION

Figure 1:
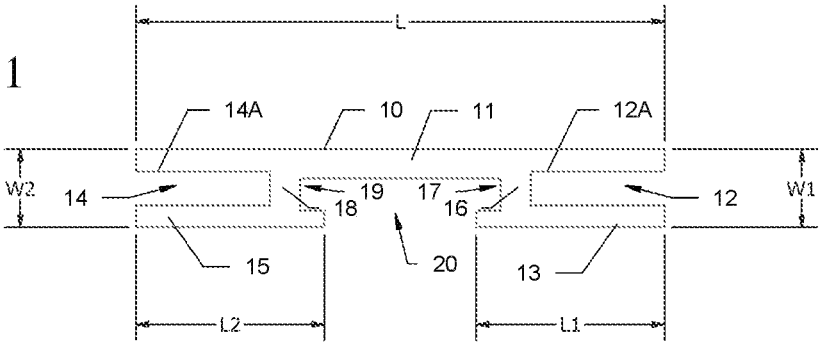
FIG. 1, illustrates a side cut-away view of an inventive universal strut according to a first embodiment of the invention.

The inventive universal strut for doors and window elements, apparatus, system, and a method thereof will now be discussed with reference to FIGS. 1 through 15. Although the scope of the present invention is much broader than any particular embodiment, a detailed description of the preferred embodiment follows together with drawings. These drawings are for illustration purposes only and are not drawn to scale. Like numbers represent like features and components in the drawings.

FIG. 1, illustrates a side cut-away view of an inventive universal strut 10, according to a first embodiment of the invention. The universal strut 10, comprises of a main leg 11, a first partial leg 13, a second partial leg 15, and wherein the first partial leg 13, is connected to the main leg 11, via a first bridge or joining member 16, to create a first U-shaped channel or female portion or blind hole 12, and a third U-shaped channel 17, along with a multipurpose chamber or channel 20. The second partial leg 15, is connected to the main leg 11, via a second bridge or joining member 18, to create a second U-shaped channel or female portion or blind hole 14, and a fourth U-shaped channel 19. The main leg 11, has a length L, while the first partial leg 13, has a length L1, and the second partial leg 15, has a length L2. The first bridge or joining member 16, has a width W1, while the second bridge or joining member 18, has a width W2. Thus having different components having different lengths and widths allows the universal strut 10, to have differing lengths, and width, along with different size openings for the first U-shaped channel 12, the second U-shaped channel 14, the third U-shaped channel 17, the fourth U-shaped channel 19, and the multipurpose chamber 20. The first U-shaped channel 12, has an internal wall 12A, or an inner wall surface 12A, and wherein the inner wall surface 12A, can have a substantially flat or planar surface 12A, or it can have at least one pocket 42, (shown in FIG. 4), or it can have at least one undulation 42, to name a few. Similarly, the second U-shaped channel 14, has an internal wall 14A, or an inner wall surface 14A, and wherein the inner wall surface 14A, can have a substantially flat or planar surface 14A, or it can have at least one pocket 44, (shown in FIG. 4), or it can have at least one undulation 44, to name a few.

Figure 2:
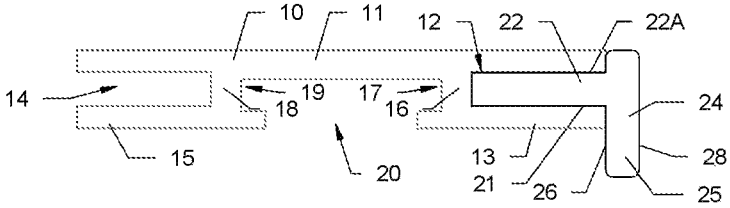
FIG. 2, illustrates a side cut-away view of an inventive universal strut mating with a first formed member according, to a second embodiment of the invention.

FIG. 2, illustrates a side cut-away view of an inventive universal strut 10, mating with a first formed member 25, according to a second embodiment of the invention. The first formed member 25, comprises of male portion or protrusion 22, having an external surface 22A, connected to a vertical member or piece 24. The first formed member 25, further has an outer or exterior surface 28, and an inner or interior surface 26. For some applications the external surface 22A, of the male portion 22, could have a surface 22A, wherein the surface 22A, could be selected from a group comprising a flat surface 22A, a planar surface 22A, an undulated surface 22A, a rough surface 22A, a ridged surface 22A, a jagged surface 22A, and combinations thereof, to name a few. Upon assembly the first formed member 25, is mated with the universal strut 10, by inserting at least a portion of the male portion 22, into at least a portion of the first female portion 12, and the inserted male portion 22, is held therein snugly, preferably, for example, via surface resistance, or via force fit. However, for some applications one could use at least one securing means 21, such as, for example, an adhesive 21, a glue 21, an epoxy 21, a bonding agent 21, and combinations thereof, to name a few, to secure the first formed member 25, to the universal strut 10.

Figure 3:
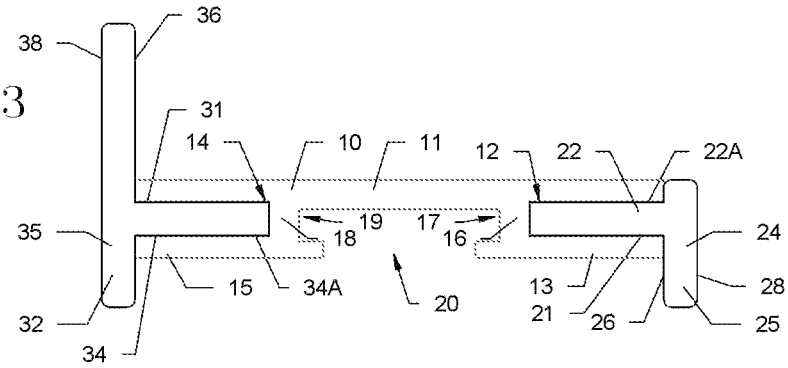
FIG. 3, illustrates a side cut-away view of an inventive universal strut mating with a second formed member according to a third embodiment of the invention.

FIG. 3, illustrates a side cut-away view of an inventive universal strut 10, mating with a second formed member 35, according to a third embodiment of the invention. The second formed member 35, comprises of male portion or protrusion 34, having an external surface 34A, connected to a vertical member or piece 32. The second formed member 35, further has an outer or exterior surface 38, and an inner or interior surface 36. For some applications the external surface 34A, of the male portion 34, could have a surface 34A, wherein the surface 34A, could be selected from a group comprising a flat surface 34A, a planar surface 34A, an undulated surface 34A, a rough surface 34A, a ridged surface 34A, a jagged surface 34A, and combinations thereof, to name a few. Upon assembly the second formed member 35, is mated with the universal strut 10, by inserting at least a portion of the male portion 34, into at least a portion of the second female portion 14, and the inserted male portion 34, is held therein snugly, preferably, for example, via surface resistance, via force fit, to name a few. However, for some applications one could use at least one securing means 31, such as, for example, an adhesive 31, a glue 31, an epoxy 31, a bonding agent 31, and combinations thereof, to name a few, to secure the second formed member 35, to the universal strut 10.

Figure 4:
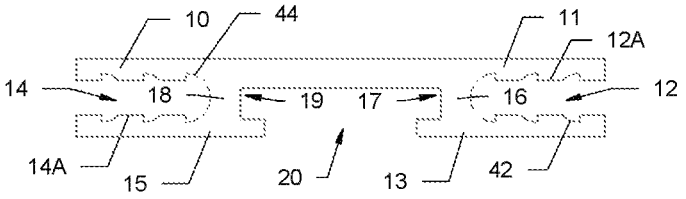
FIG. 4, illustrates a side cut-away view of an inventive universal strut according to a fourth embodiment of the invention.

FIG. 4, illustrates a side cut-away view of an inventive universal strut 10, according to a fourth embodiment of the invention. The universal strut 10, comprises of a main leg 11, a first partial leg 13, a second partial leg 15, and wherein the first partial leg 13, is connected to the main leg 11, via a first bridge or joining member 16, to create a first U-shaped channel or female portion 12, and a third U-shaped channel 17, along with a multipurpose chamber or channel 20. The second partial leg 15, is connected to the main leg 11, via a second bridge or joining member 18, to create a second U-shaped channel or female portion 14, and a fourth U-shaped channel 19. The first U-shaped channel 12, has at least one groove or striation or mini-pockets or undulation or ridges 42, along the surface 12A. The second U-shaped channel 14, has at least one groove or striation or mini pockets or undulations or ridges 44, along the surface 14A.

Figure 5:
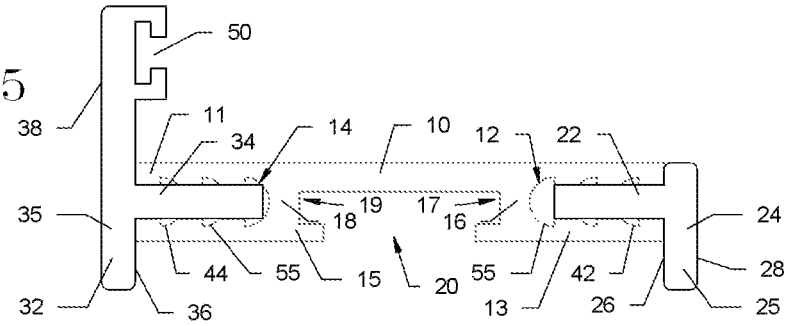
FIG. 5, illustrates a side cut-away view of an inventive universal strut mating with two formed members according to a fifth embodiment of the invention.

FIG. 5, illustrates a side cut-away view of an inventive universal strut 10, mating with two formed members 25, 35, according to a fifth embodiment of the invention. The first formed member 25, comprises of male portion or protrusion 22, connected to a vertical member or piece 24. The first formed member 25, further has an outer or exterior surface 28, and an inner or interior surface 26. Upon assembly the first, formed member 25, is mated with the universal strut 10, by inserting a portion of the male portion 22, into the first female portion 12, and the male portion 22, is held therein snugly, preferably, via surface resistance. The second formed member 35, comprises of male portion or protrusion 34, connected to a vertical member or piece 32. The second formed member 35, further has an outer or exterior surface 38, and an inner or interior surface 36. Upon assembly the second formed member 35, is mated with the universal strut 10, by inserting a portion of the male portion 34, into the second female portion 14, and the male portion 34, is held therein snugly, preferably, via surface resistance. The second formed member 35, has at least one second multipurpose chamber 50. It should be appreciated that the at least one groove 42, 44, could also be used for the snug fitting of the male portion 22, 34, inside the female portion 12, 14, respectively. For some applications, one could also insert a securing means 55, such as, glue 55, epoxy 55, adhesive 55, to name a few, so as to temporarily or permanently secure the male portion 22, 34, inside the female portion 12, 14, respectively. It should be appreciated that the presence of the at least one epoxy 55, or at least one adhesive 55, into the at least one groove 42, 44, or first female portion 12, or second female portion 14, further enhances the stability and mating of the first formed substrate 25, and/or the second formed substrate 35, to the universal strut 10. For some applications the first formed member or substrate 25, could also have at least one multi-purpose chamber 50.

Figure 6:
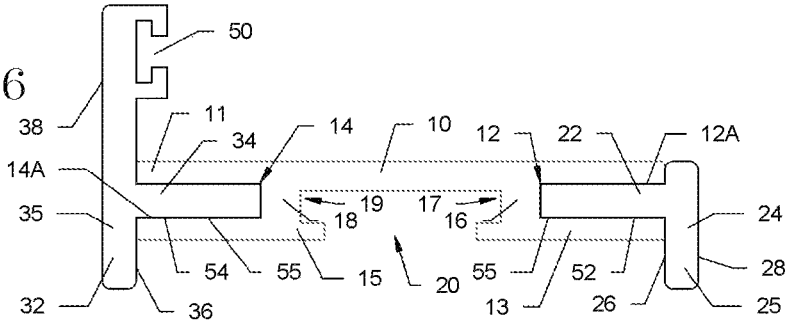
FIG. 6, illustrates a side cut-away view of an inventive universal strut mating with two formed members according to a sixth embodiment of the invention.

FIG. 6, illustrates a side cut-away view of an inventive universal strut 10, mating with two formed members 25, 35, according to a sixth embodiment of the invention. The first formed member 25, comprises of male portion or protrusion 22, connected to a vertical member or piece 24. The first formed member 25, further has an outer or exterior surface 28, and an inner or interior surface 26. Upon assembly the first formed member 25, is mated with the universal strut 10, by inserting at least a portion of the male portion 22, into at least a portion of the first female portion 12, and the male portion 22, is held therein snugly, preferably, via surface resistance. The second formed member 35, comprises of male portion or protrusion 34, connected to a vertical member or piece 32. The second formed member 35, further has an outer or exterior surface 38, and an inner or interior surface 36. Upon assembly the second formed member 35, is mated with the universal strut 10, by inserting at least a portion of the male portion 34, into at least a portion of the second female portion 14, and the male portion 34, is held therein snugly, preferably, for example, via surface resistance or force fit. The second formed member 35, is shown as having at least one second multipurpose chamber 50. For some applications the first formed member or substrate 25, could also have at least one multi-purpose chamber 50.

Figure 7:
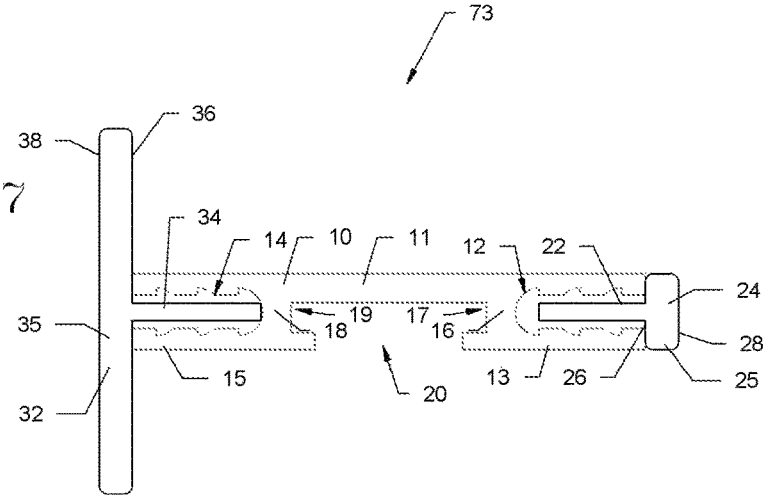
FIG. 7, illustrates a side cut-away view of an inventive universal strut mating with two formed members and forming an "T" shape according to a seventh embodiment of the invention.

FIG. 7, illustrates a side cut-away view of an inventive universal strut 10, mating with two formed members 25, 35, as discussed earlier, and forming an "T" shape 73, according to a seventh embodiment of the invention.

Figure 8:
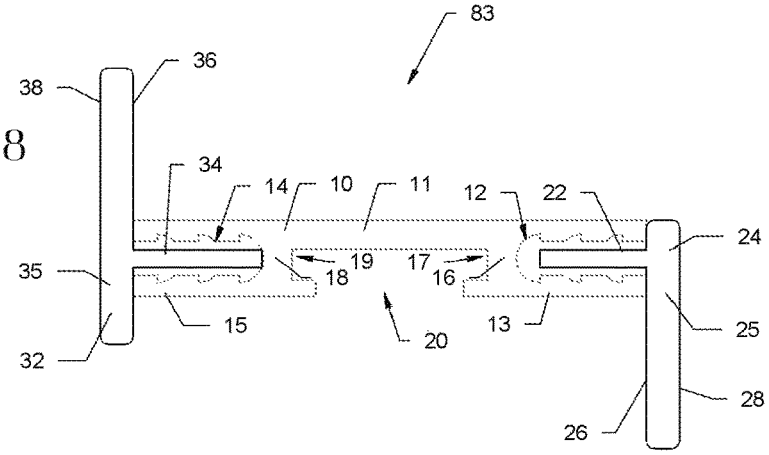
FIG. 8, illustrates a side cut-away view of an inventive universal strut mating with two formed members and forming an "Z" shape according to an eighth embodiment of the invention.

FIG. 8, illustrates a side cut-away view of an inventive universal strut 10, mating with two formed members 25, 35, as discussed earlier, and forming an "Z" shape 83, according to an eighth embodiment of the invention.

Figure 9:
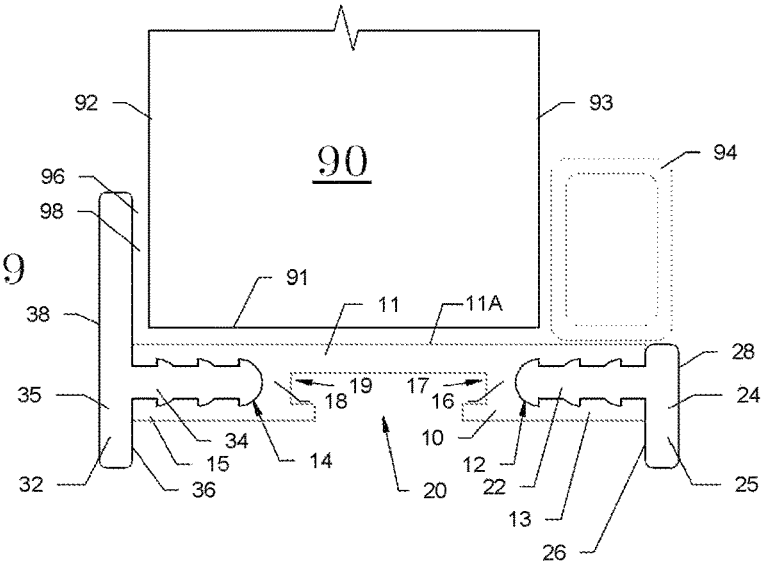
FIG. 9, illustrates a side cut-away view of at least one glass panel and a glazing compound being secure to an inventive universal strut having two formed members secured thereto according to a ninth embodiment of the invention.

FIG. 9, illustrates a side cut-away view of at least one glass panel 90, and a glazing bead or compound 94, being secure to an inventive universal strut 10, having two formed members 25, 35, secured thereto according to a ninth embodiment of the invention. The at least one glass panel 90, has an edge 91, an exterior or outer surface 92, and an interior or inner surface 93. It should be understood that the glass panel 90, could comprise of a single pane or panel of glass 90, or a plurality of glass panels 90. It should further be appreciated that the outer or exterior surface 92, of the at least one glass panel 90, is positioned towards or against the interior surface 26, of the first formed member 25, while the edge 91, is adjacent outer surface 11A, of the main leg 11. For some applications one could also use at least one the glazing compound 94, to securely hold the inner or interior surface 93, of the at least one glass panel 90. It should be appreciated that the glazing bead 94, is used to hold the at least one pane of glass 90, mounted adjacent the universal strut 10, in place against the window frame 25, or first formed member 25. For some applications one could also place at least one glazing tape 96, or at least one securing means 96, between the exterior surface 92, of the at least one glass pane 90, and the inner surface 36, of the second formed member 35. Similarly, for some applications one could also place at least one sealant 98, and/or at least one weather strip 98, between the exterior surface 92, of the glass pane 90, and the inner surface 36, of the second formed member 35. It should be appreciated that the at least one glazing bead 94, at least one glazing tape 96, at least one securing means 96, the at least one weather strip 98, the at least one sealant 98, are all placed along the peripheral edges 91, of the at least one glass panel or pane 90. It should be appreciated that the at least one weather strip 98, can be securely placed along any peripheral edge as well known to a person skilled in the art, such as, for example, edges of the frame 145, edges of a window 140, along a peripheral edge of the first formed substrate 25, along a peripheral edge of the second formed substrate 35, to name a few.

Figure 10:
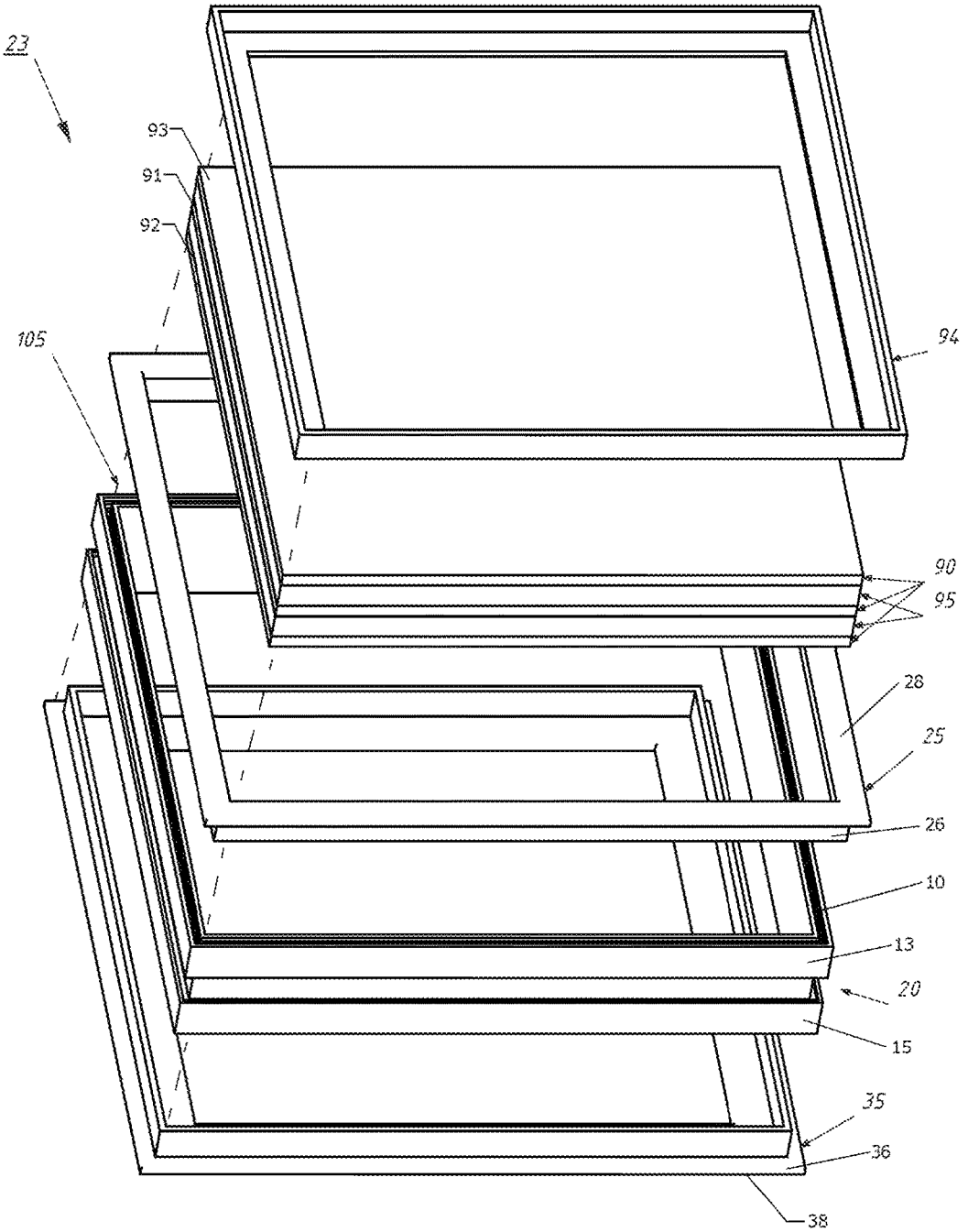
FIG. 10, shows a front perspective exploded view of an inventive window or door using the inventive universal strut, according to a tenth embodiment of the invention.

FIG. 10, shows a front perspective exploded view of an inventive window or door 23, using the inventive universal strut 10, according to a tenth embodiment of the invention. The window or door 23, comprises of the universal strut 10, which has secured thereto at one end a first formed substrate 25, and at the other end a second formed substrate 35, and forming a frame 105. At least one glass panel 100, (shown in FIG. 15), is securely held inside the frame 105, and a glazing bead 94, or a retaining glass molding 94, or a snap-in angle 94, is then placed inside the frame 105, to secure the at least one glass panel 90, 100, inside the frame 105. The at least one glass panel 90, 100, could be a single panel of glass 90, 100, or could comprise a plurality of glass panels 90, 100. For some applications one could have at least one spacer 95, between at least one glass 90, 100, to form the at least one glass panel 90, 100. It should be appreciated that a plurality of glass pane or panel 90, 100, increase the thermal efficiencies of the glass window or door.

The at least one glass panel or pane 90, 100, could be selected from a group comprising, for example, regular glass, polycarbonate glass, Lexan, clear float glass, transparent glass, translucent glass, tinted glass, reflective glass, stained glass, toughened glass, tempered glass, laminated glass, low-emissivity glass, double glazed glass, glass made from a composite material, to name a few.

Figure 11:
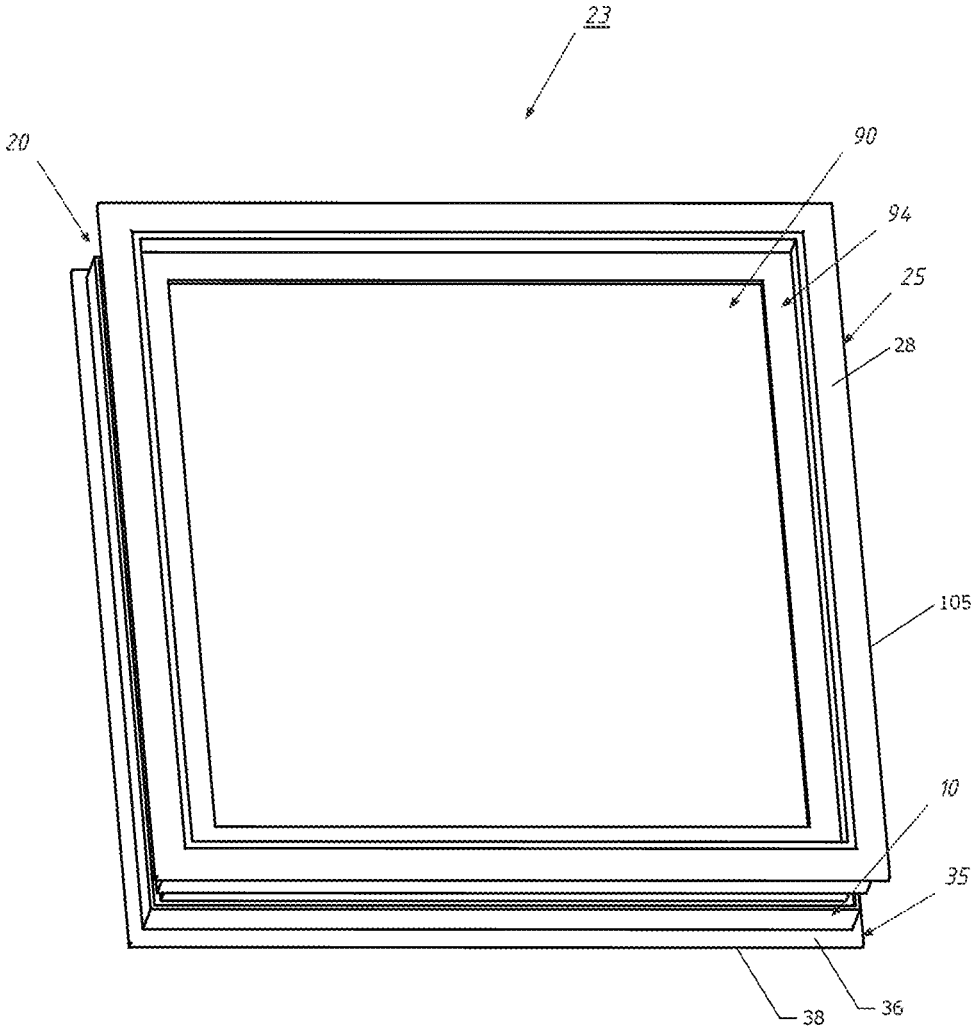
FIG. 11, shows a front perspective view of an inventive window or door using the inventive universal strut of FIG. 10, after assembly.

FIG. 11, shows a front perspective view of an inventive window or door 23, using the inventive universal strut 10, of FIG. 10 after assembly.

Figure 12:
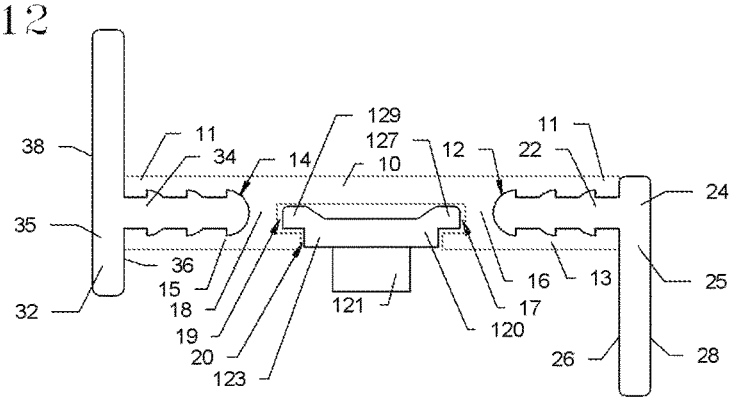
FIG. 12, illustrates a side cut-away view of an inventive universal strut mating with two formed members and having a locking mechanism inside a multipurpose chamber of the inventive universal strut according to a eleventh embodiment of the invention.

FIG. 12, illustrates a side cut-away view of an inventive universal strut 10, mating with two formed members 25, 35, and having at least one locking mechanism 123, inside the multipurpose chamber 20, of the inventive universal strut 10, according to a eleventh embodiment of the invention. The mating of the inventive universal strut 10, with the two formed members 25, 35, has been discussed earlier, and that discussion is incorporated herein by reference. For some applications the at least one locking mechanism 123, comprises of T-shaped bar or member 120, having a first wing or leg 127, a second wing or leg 129, and a male portion or protrusion 121. The first leg 127, is positioned inside the U-shaped channel 17, while the second leg 129, is positioned inside the U-shaped channel 19, and thus the T-shaped member 120, can easily slide within the two U-shaped channels 17, 19. It should also be appreciated that the universal strut 10, having the multi-purpose channel or chamber 20, which can be used for a variety of things, such as, for example, placement of at least one gasket, can be used with various installation methods, a system that needs a multi-point lock, or locking means 123, to name a few.

Figure 13:
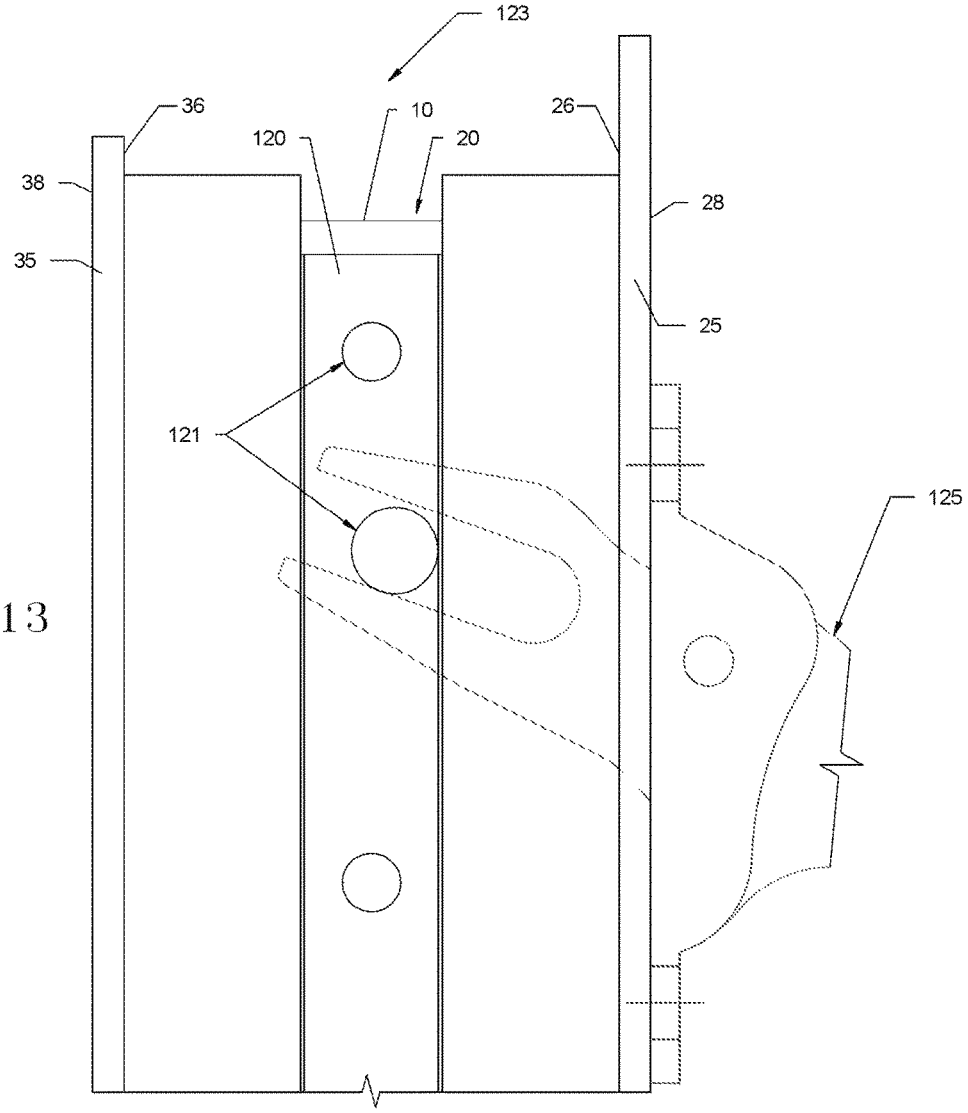
FIG. 13, illustrates a side cut-away view of an inventive universal strut mating with two formed members and having a locking mechanism inside a multipurpose chamber and at least one handle secured thereto according to a twelfth embodiment of the invention.

FIG. 13, illustrates a side cut-away view of an inventive universal strut 10, mating with two formed members 25, 35, and having at least one locking mechanism 123, inside a multipurpose chamber 20, and at least one handle or knob 125, secured thereto according to a twelfth embodiment of the invention. One end of the handle or knob 125, typically protrudes out of the exterior surface 28, of the first formed member 25, while the other end is in a moveable arrangement with the male portion 121, of the locking mechanism 123.

Figure 14:
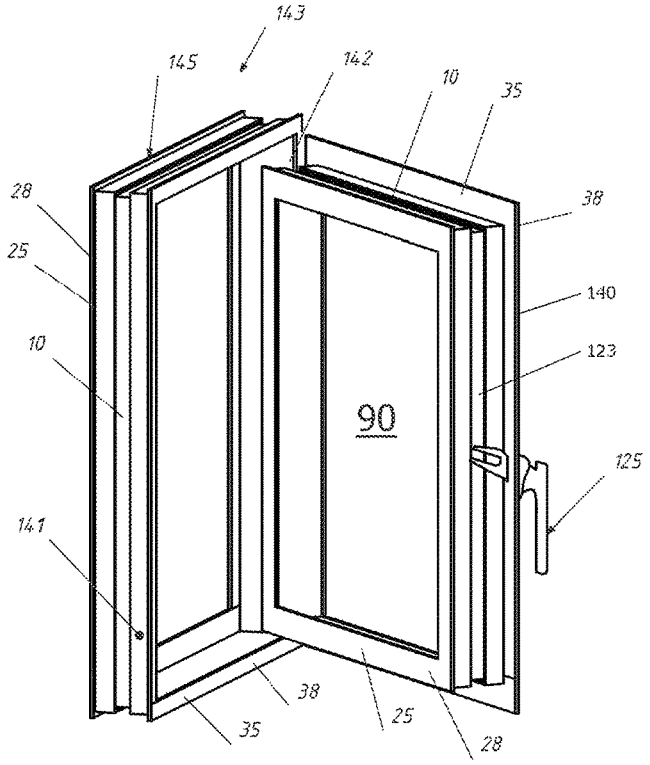
FIG. 14, illustrates a perspective view of window or door utilizing the inventive universal strut according to a thirteenth embodiment of the invention.

FIG. 14, illustrates a perspective view of window or door 143, utilizing the inventive universal strut 10, according to a thirteenth embodiment of the invention. The window or door 143, further comprises of a frame 145, and an inner window or door 140, that moves about the frame 145, via at least one moveable means 142, such as, for example, at least one hinge 142. The frame 145, has at least one catching or locking means or female portion 141, which interacts with the male portion 121, of the locking mechanism 123, to temporarily and securely lock the inner window or door 140, to the frame 145.

Figure 15:
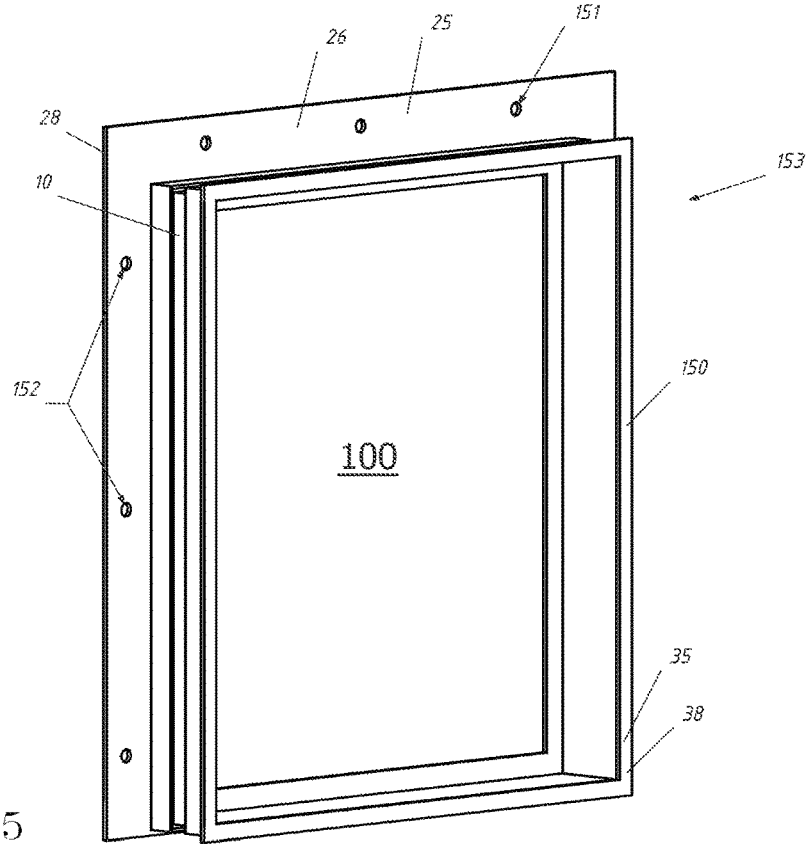
FIG. 15, illustrates a perspective view of window or door utilizing the inventive universal strut according to a fourteenth embodiment of the invention.

FIG. 15, illustrates a perspective view of window 150, or door 153, utilizing the inventive universal strut 10, according to a fourteenth embodiment of the invention. For some applications one could have one or more hole or opening 151, for securing the window 150, or door 153, to a window frame or a door frame of a house (not shown). Similarly, for some applications the window 150, or door 153, could have one or more fingers, or protrusions, or male portion 152, for securing the window 150, or door 153, to a window frame or a door frame of a house (not shown). It should be appreciated that for some applications the male portion 152, could also be used as guide or alignment during the installation of the window 150, or door 153.

The inventive universal strut 10, having different lengths and widths for the main leg 11, first partial leg 13, second partial leg 15, first joining member 16, second joining member 18, allows mating the inventive universal strut 10 to a variety of first formed member 25, and second formed member 35. Thus, for example, for a single pane 90, application one could use a universal strut 10, having a first leg 11, having a length L, but for example, for a three pane system 100, application one would use a strut 10, having a longer length L, to accommodate the thicker glass assembly 100. Similarly, for a first formed member 25, having a fat or thicker male portion 22, the universal strut 10, could have first bridge 16, which is longer to get a wider first U-shaped channel 12, to accommodate the fat or thicker male portion 22, of the first formed member 25. Similarly, for a second formed member 35, having a thinner male portion 34, the universal strut 10, could have second bridge 18, which is shorter to get a narrower second U-shaped channel 14, to accommodate the thinner male portion 34, of the second formed member 35. Similarly, the opening for the multipurpose chamber 20, could also be varied based on the lengths L1, L2, of the first partial leg 13, and second partial leg 15, respectively, and/or the width W1, W2, of the first bridge 16, and second bridge 18, respectively. This flexibility allows the universal strut 10, to be used for production or customized window, door, window frame, or door frame. Thus, the system using the inventive universal strut 10, allows almost any combination of the first formed substrate 25, and the second formed substrates 35, to be joined together to create windows and doors, and their supporting elements. It should also be understood that the first partial leg 13, having a length L1, could have the same length as that of the second partial leg 15, or it could be different. Similarly, it should be understood that the width W1, could be the same as width W2, or it could be different.

For some applications it is preferred that the universal strut 10, is made from a material that is a thermal barrier between the first formed member 25, and the second formed member 35. Thus, for example, if the exterior surface 28, of the first formed member 25, is exposed to extreme heat or cold temperatures then that heat or cold would not be passed or transferred through to the second formed member 35, as the universal strut 10, would act as a thermal barrier 10, between the first formed member 25, and the second formed member 35.

As stated earlier that the universal strut 10, allows for the formation of various configurations for the shapes of window and/or door elements. Two such configurations are shown in in FIG. 7, and FIG. 8, such as, a "T" shape in FIG. 7, and a "Z" shape in FIG. 8. However, using various lengths for the first formed member 25, and the second formed member 35, a person skilled in the art, could have other shapes, such as, for example, an "H" shape, an "I" shape, a "U" shape, to name a few.

It should also be understood that the position of the first formed member 25, and the second formed member 35, could be swapped or changed depending upon the placement of the window or door elements, such as, for example, glass pane 90, 100, locking mechanism 123, handle or knob 125, to name a few.

It should be appreciated that the material for the universal strut 10, could be selected from a group comprising, aluminum, bronze, vinyl, pultrusion, plastic, polyamide, wood, steel, stainless steel, fiberglass, ceramic, composite material, and combination thereof, to name a few. It should be understood that the universal strut 10, acts as a thermal barrier because it is made from a material that prevents the transfer of heat or energy from the first formed member 25, to the second formed member 35. Thus, for applications where the universal strut 10, is being used as a thermal barrier then care must be taken to make sure that the material selected for the universal strut 10, meets the requirement of a thermal barrier for that particular application. This could be achieved in a number of ways, for example, if the first formed member 25, and the second formed member 35, are made from a metallic material, then one could use a non-metallic material for the universal strut 10, thus preventing the transfer of heat or thermal energy from the first formed member 25, to the second formed member 35.

It is preferred that the universal strut 10, is made from a non-metallic material or thermal barrier material. The material for the universal strut 10, could be selected from a group comprising, aluminum, bronze, vinyl, pultrusion, plastic, polyamide, wood, steel, stainless steel, composite material, and combinations thereof, to name a few. And, it is preferred that the first formed member 25, and the second formed member 35, are made from a metallic material. For some applications, the material for the formed substrates or members 25, 35, could be selected from a group comprising, aluminum, bronze, vinyl, pultrusion, plastic, polyamide, wood, steel, stainless steel, composite material, and combinations thereof, to name a few.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and systems described herein may be embodied in a variety of other forms, furthermore, various omissions, substitutions and changes in the form of the methods and systems described herein may be made without departing from the spirit of the inventions.

It should be further understood that throughout the specification and claims several terms have been used and they take the meanings explicitly associated herein, unless the context clearly dictates otherwise. For example, the phrase "in one embodiment" as used herein does not necessarily refer to the same embodiment, though it may. Additionally, the phrase "in another embodiment" as used herein does not necessarily refer to a different embodiment, although it may. Thus, various embodiments of the invention may be readily combined, without departing from the scope or spirit of the invention.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A window or door element, comprising:

(a) a universal strut, said universal strut comprising a first leg, a first partial leg, and a second partial leg, and wherein said first partial leg is connected to said first leg via at least one first connecting member to form a first external U-shaped channel, and a first internal U-shaped channel, and said second partial leg is connected to said first leg via at least one second connecting member to form a second external U-shaped channel, and a second internal U-shaped channel, and wherein said first partial leg, and said second partial leg are along a first side of said first leg, and, wherein said first internal U-shaped channel, and said second internal U-shaped channel form a multi-purpose C-shaped channel;

(b) a first formed member having a first male portion, and wherein at least a portion of said first male portion is secured inside at least a portion of said first external U-shaped channel;

(c) a second formed member having a second male portion, and wherein at least a portion of said second male portion is secured inside at least a portion of said second external U-shaped channel; and (d) wherein said universal strut, said first formed member, and said second formed member form a frame for said window or door element.

2. The window or door element of claim 1, wherein at least one glazing bead is secured to said frame.

3. The window or door element of claim 1, wherein at least one sealant is secured to said frame.

4. The window or door element of claim 1, wherein at least one glazing tape is secured to said frame.

5. The window or door element of claim 1, wherein said window or door element has at least one securing means, and wherein said at least one securing means is selected from a group consisting of an adhesive, a glue, an epoxy, a bonding agent, and combinations thereof.

6. The window or door element of claim 1, wherein material for said universal strut is selected from a group consisting of aluminum, bronze, vinyl, pultrusion, plastic, polyamide, wood, steel, stainless steel, fiberglass, ceramic, composite material, and combination thereof.

7. The window or door element of claim 1, wherein material for said first formed member and said second formed member is selected from a group consisting of aluminum, bronze, vinyl, pultrusion, plastic, polyamide, wood, steel, stainless steel, composite material, and combinations thereof.

8. The window or door element of claim 1, wherein said universal strut is made from a thermal barrier material, and wherein said first formed member and said second formed member are made from a metallic material.

9. A window or door element, comprising:

(a) a universal strut, said universal strut comprising a first leg, a first partial leg, and a second partial leg, and wherein said first partial leg is connected to said first leg via at least one first connecting member to form a first external U-shaped channel, and a first internal U-shaped channel, and said second partial leg is connected to said first leg via at least one second connecting member to form a second external U-shaped channel, and a second internal U-shaped channel, and wherein said first partial leg, and said second partial leg are along a first side of said first leg, and, wherein said first internal U-shaped channel, and said second internal U-shaped channel form a multi-purpose C-shaped channel;

(b) a first formed member having a first male portion, and wherein at least a portion of said first male portion is secured inside at least a portion of said first external U-shaped channel;

(c) a second formed member having a second male portion, and wherein at least a portion of said second male portion is secured inside at least a portion of said second external U-shaped channel;

(d) said universal strut, said first formed member, and said second formed member form a frame for said window or door element;

(e) at least one glass pane secured inside said frame;

(f) wherein material for said universal strut is selected from a group consisting of aluminum, bronze, vinyl, pultrusion, plastic, polyamide, wood, steel, stainless steel, fiberglass, ceramic, composite material, and combination thereof; and (g) wherein material for said first formed member and said second formed member is selected from a group consisting of aluminum, bronze, vinyl, pultrusion, plastic, polyamide, wood, steel, stainless steel, composite material, and combinations thereof.

10. The window or door element of claim 9, wherein at least one glazing bead is secured to said frame.

11. The window or door element of claim 9, wherein at least one sealant is secured to said frame.

12. The window or door element of claim 9, wherein at least one glazing tape is secured to said frame.

13. The window or door element of claim 9, wherein said window or door element has at least one securing means, and wherein said at least one securing means is selected from a group consisting of an adhesive, a glue, an epoxy, a bonding agent, and combinations thereof.

14. The window or door element of claim 9, wherein said universal strut is made from a thermal barrier material, and wherein said first formed member and said second formed member are made from a metallic material.

15. The window or door element of claim 9, wherein one of said first male portion and said second male portion has an external surface, and wherein said external surface is selected from a group consisting of a flat surface, a planar surface, an undulated surface, a rough surface, a ridged surface, a jagged surface, and combinations thereof.

16. The window or door element of claim 9, wherein one of said first external U-shaped channel and said second external U-shaped channel has an inner wall surface, and wherein said inner wall surface is selected from a group consisting of a substantially flat surface, a planar surface, a surface having at least one pocket, a surface having undulation, a surface having at least one groove, a surface having striation, a surface having ridges, a surface having mini-pockets, and combinations thereof.

17. The window or door element of claim 9, wherein at least one locking mechanism has a T-shaped member having a first locking leg, and a second locking leg, and wherein said first locking leg slideably engages inside said first internal U-shaped channel, and wherein said second locking leg slideably engages inside said second internal U-shaped channel.

18. The window or door element of claim 1, wherein one of said first male portion and said second male portion has an external surface, and wherein said external surface is selected from a group consisting of a flat surface, a planar surface, an undulated surface, a rough surface, a ridged surface, a jagged surface, and combinations thereof.

19. The window or door element of claim 1, wherein one of said first external U-shaped channel and said second external U-shaped channel has an inner wall surface, and wherein said inner wall surface is selected from a group consisting of a substantially flat surface, a planar surface, a surface having at least one pocket, a surface having undulation, a surface having at least one groove, a surface having striation, a surface having ridges, a surface having mini-pockets, and combinations thereof.

20. The window or door element of claim 1, wherein at least one locking mechanism has a T-shaped member having a first locking leg, and a second locking leg, and wherein said first locking leg slideably engages inside said first internal U-shaped channel, and wherein said second locking leg slideably engages inside said second internal U-shaped channel.

* * * * *